US005942052A

United States Patent [19]

Kamimura et al.

[11] Patent Number: 5,942,052

[45] Date of Patent: Aug. 24, 1999

[54] SURFACE TREATMENT AQUEOUS SOLUTION FOR METAL

[75] Inventors: Masayuki Kamimura, Ichikawa; Satoshi Miyamoto, Yokohama; Yasuo Matsuura, Osaka, all of Japan

[73] Assignee: Nippon Paint Co., Ltd., Osaka, Japan

[21] Appl. No.: 08/708,916

[22] Filed: Sep. 5, 1996

Related U.S. Application Data

[63] Continuation of application No. 08/421,263, Apr. 13, 1995, abandoned.

[30] Foreign Application Priority Data

Apr. 20, 1994 [JP] Japan ..... 6-081795

[51] Int. Cl.[6] ..... C23C 22/00

[52] U.S. Cl. ..... 148/250; 148/254; 148/259; 148/260; 148/261; 148/273

[58] Field of Search ..... 148/250, 254, 148/259, 260, 261, 273

[56] References Cited

U.S. PATENT DOCUMENTS

| | | | |
|---|---|---|---|
| 3,459,600 | 8/1969 | Sedlak | 148/250 |
| 3,630,790 | 12/1971 | Schmidt | 148/250 |
| 3,816,184 | 6/1974 | Redmore | 148/250 |
| 4,927,472 | 5/1990 | Matsushima et al. | 148/261 |
| 4,980,076 | 12/1990 | Tanaka et al. | 252/79.4 |

FOREIGN PATENT DOCUMENTS

| | | | |
|---|---|---|---|
| 0084593 | 8/1983 | European Pat. Off. . | |
| 0312176 | 4/1989 | European Pat. Off. . | |
| 52-53739 | 10/1975 | Japan . | |
| 0005879 | 1/1982 | Japan | 148/250 |
| 215178 | 1/1990 | Japan . | |

OTHER PUBLICATIONS

EP 0084593 Aug., 1983.

*Primary Examiner*—David A. Simmons
*Assistant Examiner*—Robert R. Koehler
*Attorney, Agent, or Firm*—Sughrue, Mion, Zinn, Macpeak & Seas, PLLC

[57] ABSTRACT

A surface treatment aqueous solution is provided which is superior in corrosion resistance and coating adhesiveness as well as in ability of inhibiting the production of precipitate. A tinned DI can, which has been degreased, is conversion coating processed in a treatment bath filled with a surface treatment aqueous solution containing at least phosphate ions, organophosphonate compound and tin ions with a pH value of 5 or less. After the conversion coating, the DI can is washed with water and dried. A preferable organophosphonate compound is one in which a phosphorus atom constituting a phosphonate group is bonded to a carbon atom.

17 Claims, No Drawings

SURFACE TREATMENT AQUEOUS SOLUTION FOR METAL

This is a Continuation of application Ser. No. 08/421,263, filed Apr. 13, 1995, abandoned.

BACKGROUND OF THE INVENTION

1. Field of the Invention

The present invention relates to a surface treatment aqueous solution for providing a conversion coating on a metal surface such as iron or iron alloy, especially on the surface of tinned iron. This invention also relates to a use of the surface treatment aqueous solution and to a process of applying the surface treatment aqueous solution to the surface of tinned iron.

2. Description of the Prior Art

Iron cans are broadly used for various canned products, as a container for food or soft drinks. Such cans are fabricated by shaping a thin iron plate into a desired size of can using a forming die or a drawing & ironing technique (DI technique). In either method, a shaped can is generally provided with an anticorrosion coating because the material itself is inferior in corrosion resistance. As an anticorrosion coating, a thin film of epoxy resin is ordinarily formed on the can's surface. Resin coating is not directly provided on the iron surface, but on the treated surface. Such a surface treatment includes a conversion coating which is preferable in view of corrosion resistance and coating adhesiveness especially for tinned iron cans.

Japan Kokai (Laid Open) H2-15178, entitled "Conversion Coating Agent and Conversion Coating Bath", discloses a conversion coating on a tinned can, using an aqueous solution containing orthophosphoric acid and/or orthophosphate with a $PO_4$ amount 1 to 30 g/l, oxalic acid and/or oxalate with a $C_2O_4$ amount 0.005 to 5.0 g/l, and 0.005 to 0.5 g/l of dihydric tin ion, with a pH value 3 to 5. The oxalic acid is added to a treatment bath as an etchant and as a chelating agent for tin ions for preventing sludge.

U.S. Pat. No. 4,927,472 entitled "Conversion Coating Solution For Treating Metal Surface" discloses an aqueous solution containing 1 to 50 g/l of phosphate ions, 0.2 to 20.0 g/l of oxyacid ions, 0.01 to 5.0 g/l of tin ions, and 0.01 to 5.0 g/l of condensed phosphate ions, with a pH value 2 to 6. The condensed phosphate ions are added as an etchant as well as a chelating agent for tin ions for preventing sludge.

Japan Kokai (SHO)52-53739 entitled "Surface Treating Method for Tin Plate" discloses a method for treating a surface of a tinned steel plate, using an aqueous solution in which one or both of phosphorous acid and hypophosphorous acid is/are added to phosphoric acid and the amount of free acid is adjusted to 5.0 to 50.0 g/l. The phosphorous acid and hypophosphorous acid are added as an etchant or a coating accelerator.

U.S. Pat. No. 4,980,076 entitled "Fluoride and Chromium Free Acid Etchant Rinse For Aluminum" discloses an acid etchant rinse for aluminum containing orthophosphoric acid in an amount to give a stoichiometric equivalent of 3.0 to 50 g/l as $PO_4^{3-}$, an aluminum ion sequestrant component in an amount of 0.01 to 10.0 g/l, 20 to 170 ppm of ferric ion, and 0.02 to 3.0 g/l of $H_2O_2$ or $NO_2^-$. As an aluminum ion sequestrant, organophosphonate is employed.

However, the conversion coating agent shown in H2-15178 has a problem that the oxalic acid contained in the treatment bath is slightly inferior in chelation ability to tin ions, and therefore it can not sufficiently hold tin ions. As a result, sludge is produced in the treatment bath, which will block a nozzle.

It is known that condensed phosphate is easily hydrolyzed in a strong acidic aqueous solution to be a phosphorate with a poor degree of polymerization. For this reason, the conversion coating solution disclosed in U.S. Pat. No. 4,927,472 has a problem that the condensed phosphate contained in the solution is quickly hydrolyzed at pH value 2 to 5 suitable for conversion coating, and chelation ability to tin ion is extremely reduced, which results in precipitate of tin salt and production of sludge. It is not economical to continuously supply condensed phosphate ions as hydrolysis advances. Further, the oxyacid promotes elution of iron ions which consume the chelating agent, resulting in insufficient trapping of tin ions and production of sludge.

In Japan Kokai (SHO)52-53739, inorganic hypophosphorous acid, such as sodium dihydrogenphosphate or ammonium dihydrogenphophate, is added as an etchant or coating accelerator. However, inorganic hypophosphorous acid is inferior in chelation ability, and therefore, accumulation of tin ions produces sludge.

The solution shown in U.S. Pat. No. 4,980,076 is an acid etchant rinse for treating aluminum or aluminum alloy, where ferric ion and an oxidizer are indispensable. This solution differs from s surface treatment aqueous solution of the present invention in structure, purpose and effect.

SUMMARY OF THE INVENTION

This invention was conceived to overcome the above described problem, and it is an object of the invention to provide a surface treatment aqueous solution capable of providing a conversion coating superior in corrosion resistance and coating adhesiveness.

In order to achieve the above object, a surface treatment aqueous solution in accordance with the invention contains at least phosphate ions, organophosphonate compound and tin ions, with a pH value being 5 or less.

The organophosphonate compound is one in which a phosphorus atom consisting of a phosphonate group is bonded to a carbon atom.

In another aspect of the invention, a use of the surface treatment aqueous solution and a process of forming a conversion coating by applying the surface treatment aqueous solution to a surface of tinned iron.

A supply source of the phosphate ions (first component) is, for example, orthophosphoric acid or orthophosphate. The orthophosphate may be one that includes at least one substituent of alkaline metal (such as sodium, potassium, lithium, etc.) or ammonium. Alternatively, the orthophosphate may be one obtained by neutralizing orthophosphoric acid with caustic alkali or carbonate alkali.

The orthophosphoric acid and orthophosphate may be used separately or all together. Combination of at least two kinds of orthophosphate is also available. The concentration of orthophosphoric acid or orthophosphate in the surface treatment aqueous solution is preferably such that the phosphate ion concentration is 1 to 30 g/l, and is more preferably, such that the phosphate ion concentration is 3 to 10 g/l. When the concentration of orthophosphonic acid or orthophosphate in the aqueous solution is such that the phosphate ion amount is less than 1 g/l, conversion coating film is not only sufficiently formed, but also inferior in corrosion resistance. On the other hand, when exceeding 30 g/l, etching of the metal surface is accelerated too much and the appearance of the can is damaged, in addition to inferior corrosion resistance and coating adhesiveness.

The preferred organophosphonate compound (second component) is one in which a phosphonate group (—$PO_3H_2$) represented below is bonded to a carbon atom.

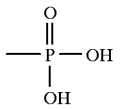

Alternatively, the organophosphonate compound may be one in which at least one of the hydrogen atoms in the phosphonate group is substituted with alkaline metal (such as sodium, potassium, lithium, etc.) or ammonium, or may be one that is obtained by neutralizing organic phosphonic acid by caustic alkali, carbonate alkali, or ammonia.

More specifically, aminotri (methylenephosphonic acid) represented by formula 1, 1-hydroxyethylidene-1,1-diphosphonic acid represented by formula 3, ethylenediaminetetra (methylenephosphonic acid) represented by formula 6, diethylenetriaminepenta (methylenephosphonic acid) represented by formula 7, or their salt (represented by formula 2, 4 and 5, respectively) are listed. Such salts include at least one substituent for each phosphonate group, the substituent being preferably alkaline metal (sodium, potassium, lithium, etc.) or ammonium.

Formula 1

Aminotri (Methylenephosphonic Acid)

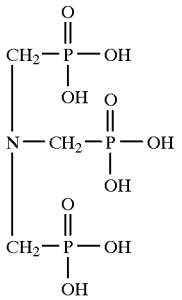

Formula 2

Aminotri (Methylenephosphonic Acid) 5Na Salt

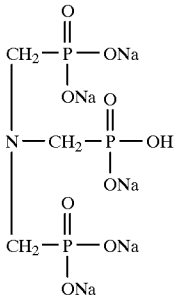

Formula 3

1-hydroxyethylidene-1, 1-diphosphonic acid

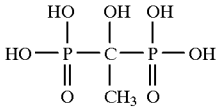

Formula 4

1-hydroxyethylidene-1, 1-diphosphonic acid 3Na Salt

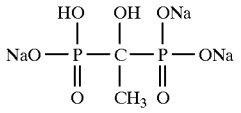

Formula 5

1-hydroxyethylidene-1, 1-diphosphonic acid 4Na Salt

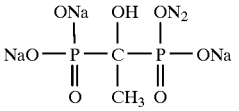

Formula 6

Ethylenediaminetetra (Methylenephosphonic Acid)

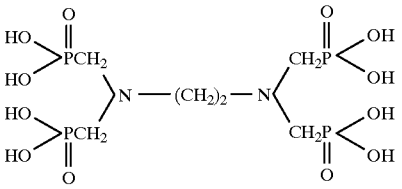

Formula 7

Diethylenetriaminepenta (Methylenephosphonic Acid)

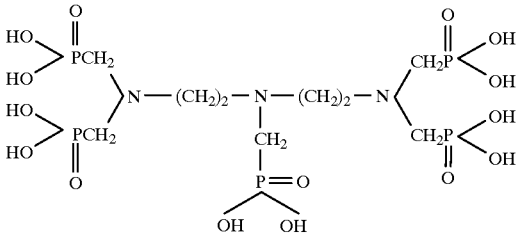

The combination of at least two organophosphonate compounds listed above is also useful.

The concentration of the organophosphonate compound in the aqueous solution is preferably 0.05 mmol/l to 50 mmol/l, and more preferably, 0.5 mmol/l to 5 mmol/l. When the concentration of the organophosphonate compound is less than 0.05 mmol/l, corrosion resistance and coating adhesiveness are insufficient, and chelation ability to tin ions is inferior, resulting in production of sludge. When exceeding 50 mmol/l, etching of the metal surface is accelerated too much, resulting in bad appearance of a can, and in addition, the corrosion resistance is reduced.

A supply source of the tin ions (third component) is stannous chloride, stannic chloride, sodium stannate, stannous sulfate, and so on. At least two of these may be mixed with divalent and tetravalent tin ions to be used as a supply source of tin ion. The concentration of the tin ions in the surface treating aqueous solution is preferably 0.005 to 5.0 g/l (i.e. 0.042 to 42 mmol/l, and more preferably, 0.05 to 0.5 g/l (i.e. 0.42 to 4.2 mmol/l).

When the concentration of the tin ions is less than 0.005 g/l, the corrosion resistance and coating adhesiveness are inferior in the resultant conversion coating. When exceeding 5.0 g/l, a large amount of sludge is produced in the treating bath, and working efficiency is reduced.

A mole ratio of tin ion (Sn) to organophosphonate compound is preferably 0.08 to 8.4, and more preferably, 0.17 to 2.8. When the mole ratio is smaller than 0.08, the corrosion resistance and coating adhesiveness are inferior in the resultant conversion coating. When the mole ratio exceeds 8.4, a large amount of sludge is produced in the treating bath, and working efficiency is reduced.

Even if the mole ratio is greater than 1, sludge is not always produced. However, in order to sufficiently chelate the tin ions, the most preferable mole ratio Sn/organophosphonate compound is 0.17 to 1.

The pH value of the surface treatment aqueous solution for metal must be less than 5. The pH value is preferably set to 2 to 5, and more preferably 2 to 3. When the pH value of the surface treatment aqueous solution is less than 2, the metal surface is etched too much, resulting in bad appearance, as well as the resultant conversion coating having an inferior corrosion resistance. When the pH value of the surface treatment aqueous solution is greater than 5, chemical conversion (reaction) does not satisfactorily advance, which makes it difficult to form a conversion coating film.

The surface treatment aqueous solution in accordance with the invention is prepared by diluting a thick treatment solution with an appropriate amount of water to an appropriate concentration range, and is poured into a treatment bath for use. The thick treatment solution contains at least orthophosphoric acid and/or orthophosphate with a phosphate ion amount 10 to 1,500 g/l, 0.5 to 2,500 mmol/l of organophosphonate compound, and 0.05 to 500 g/l of tin ion, with a pH value being 4 or less.

Although, in the surface treatment bath, phosphoric acid and organophosphate compound are easily consumed, the concentration of these substance can be kept constant by an automatic supply system. Tin ions continuously dissolve into the surface treatment aqueous solution from a tin plating film formed on the metal surface during the chemical conversion, which will form a coating film by reacting with an acid component which is constantly supplied into the treatment bath.

Prior to the conversion coating using a surface treatment aqueous solution of the invention, the surface of a tinned metal (such as tinned iron) is degreased and water washed. Then, the the surface treatment aqueous solution is applied to the tinned metal by an arbitrary method, such as immersing or spraying. Treating temperature is within the range between the room temperature and 80° C., preferably, 40 to 60° C. The treating time is generally 5 seconds to 2 minutes, and preferably 20 to 60 seconds. After the application of the surface treatment aqueous solution, the treated can is first washed with tap water, then washed with pure water, and is finally dried.

When applying the surface treatment aqueous solution to a tinned surface of a can, the tin plating layer on the metal surface is etched by phosphoric acid and organophosphonate compound. The tin ions dissolve into the surface treatment aqueous solution, which then reacts with phosphoric acid and organophosphate compound to form an insoluble tin phosphate. The insoluble tin phosphate is to cover the exposed iron surface of the can as a conversion coat with a superior corrosion resistance and coating adhesiveness.

Besides the etching ability, the organophosphonate compound has a chelation ability for tin ions contained in the surface treatment aqueous solution. Condensed phosphoric acid used in the prior art solution, such as pyrophosphoric acid or tripolyphosphoric acid, consists of plural $PO_4$ pyramids bonded to each other bridged by oxygen atoms. Due to this structure, it is easily hydrolyzed when the P—O—P bonding is attacked by hydrogen ions. Especially at high temperature and in a strong acidic range, the condensed phosphoric acid is remarkably hydrolyzed to become phosphoric acid having a low degree of polymerization which lacks sufficient chelation ability for tin ions contained in the surface treatment aqueous solution, resulting in production of sludge.

On the contrary, organophosphate compound, in which the phosphonate group ($—PO_3H_2$) is bonded to a carbon atom, is scarcely subjected to hydrolysis and can stably exist over a broad pH range. Accordingly, chelation ability for tin ions is constant, and there is no need to supply a large amount of chelating agent during the conversion coating treatment, unlike the case of condensed phosphoric acid. It is considered that a phosphonate compound which acts to chelate tin ions is taken into a coating film as a superior ingredient. Thus, the organophosphonate compound contained in the surface treatment aqueous solution in accordance with the invention has multiple functions, and serves as an etchant and chelating agent as well as a film forming ingredient. By using such an advantageous component, both working and economical efficiencies are improved, with superior corrosion resistance and coating adhesiveness.

DESCRIPTION OF THE PREFERRED EMBODIMENT

Experimentation was carried out by comparing actual examples in accordance with the invention with other examples for comparison. In the experimentation, (1) external appearance of resultant cans, (2) corrosion resistance of cans prior to epoxy coating, (3) corrosion resistance of cans after epoxy coating, and (4) coating adhesiveness, were evaluated in the following manner.

(1) External Appearance

The external appearance of cans, which have been subjected to conversion coating treatment and dried, was observed with the naked eye and evaluated according to the following scale.

Excellent: Glossy

Average: medium glossiness

Poor: Poor glossiness and yellowed surface (2) Corrosion Resistance Prior To Epoxy Coating A number of can side wall portions, which had been subjected to conversion coating treatment and dried, were cut out to a size of 3 cm×4 cm, for the test pieces. The test pieces were taped so that a 1 cm×1 cm area of the inside surface was exposed, which was then immersed into 2.8 g/l of phosphoric acid aqueous solution (adjusted with NaOH so as to be pH 2.4) at 40° C. for 48 hours. After that, the corrosion advancing state was observed and evaluated according to the following scale.

Excellent: corroded area is 0%

Good: corroded area is less than 5%

Average: corroded area is 5% or more and less than 20%

Inferior: corroded area is 20% or more and less than 50%

Poor: corroded area is 50% or more (3) Corrosion Resistance After Epoxy Coating

Commercially available epoxy coating was applied to the inside surface of cans to a thickness of 4 to 5 μm, and the coated cans were baked at 210° C. Then side wall portions of the coated cans were cut out to a size of 5 cm×5 cm to make test pieces. The exposed cut edges and back were taped, and the coated surfaces scarred in the lateral direction to a length of 3 cm until reaching the metal surface in the depth direction. The test pieces were immersed into 1.3 g/l of citric acid aqueous solution (adjusted by NaOH to be pH 3.6) at 40° C. for 30 days. After that, the corrosion advancing state was observed and evaluated according to the following scale.

Excellent: Width of corroded area is smaller than 5 mm

Good: Corroded width is 5 mm or more, and less than 10 mm

Average: Corroded width is 10 mm or more, and less than 15 mm

Inferior: Corroded width is 15 mm or more, and less than 20 mm

Poor: Corroded width is 20 mm or more (4) Coating adhesiveness

The same epoxy coated cans as those used in the test (3) were used in this test. Side wall portions of the coated cans were cut out to a size of 5 cm×10 cm as test portions, which were immersed in 50 g/l of boiling acetic acid aqueous solution for 30 minutes. The coated surfaces of the test pieces were scratched so as to draw a hundred 1 mm×1 mm squares like a chessboard to the depth of the metal surface. Then, an adhesive tape was stuck onto the scratched portions and quickly peeled off. The peeling conditions were observed and evaluated according to the following scale.

Excellent: Peeled area is 0%

Good: Peeled area is less than 5%

Average: Peeled area is 5% or more, and less than 20%

Inferior: Peeled area is 20% or more, and less than 50%

Poor: Peeled area is 50% or more

ACTUAL EXAMPLES 1 to 25 IN ACCORDANCE WITH THE INVENTION AND COMPARISON EXAMPLES 1 to 6

Tinned steel plate with 2.8 g/m$^2$ of tin plating was employed to fabricate DI cans (i.e. cans made by a DI technique). The DI cans were degreased using 10 g/l of an alkaline degreasing agent (SURFCLEANER SN311, Nippon Paint Co., Ltd.; "SURFCLEANER" is a registered trademark), and were water washed. Then, the cans were subjected to spray treatment at 50° C. for 30 seconds with a surface treatment aqueous solution having a composition and a pH value shown in Tables 1 to 4. In the experimentation, orthophosphonic acid ($H_3PO_4$) was used as a supply source of "$PO_4^{3-}$". As an organophosphonate compound, 1-hydroxyethylidene-1,1-diphosphonic acid (referred to as "A" in the tables) and/or aminotri (methylenephosphonic acid) (referred to as "B" in the tables) were used. $SnCl_2$ $2H_2O$ ($Sn^{2+}$ in the aqueous solution) and/or $Na_2SnO_3$ $3H_2O$ ($Sn^{4+}$ in the aqueous solution) were added for a supply source of tin ions. The pH value was adjusted by sodium hydroxide (NaOH). After the spray treatment, the cans were washed first with tap water, then with pure water, and finally dried at 200° C. for 3 minutes.

The external appearance and corrosion resistance of the thus processed cans were evaluated prior to epoxy resin coating.

Then, a commercially available epoxy resin coating was applied onto the DI cans, which had been subjected to the conversion coating, to a thickness of 4 to 5 μm. The coated cans were baked at 210° C.

The corrosion resistance after epoxy resin coating and coating adhesiveness was evaluated.

Also, production of sludge was observed after leaving the cans at room temperature for a day. Evaluation was made with the following scale.

Excellent: No sludge was produced

Average: A little sludge was produced

Poor: A significant amount of sludge was produced

TABLE 1

| Actual examples | Composition: $PO_4^{3-}$ (g/l) | Organophosphnate compound(mmol/l) (A) | (B) | Tin ion (g/l) $Sn^{+2}$ | $Sn^{4+}$ | Tin ion/ Organophosphnate compound (mole-ratio) | Treatment Temperature (°C.) | pH | Spray Treatment Time (second) |
|---|---|---|---|---|---|---|---|---|---|
| 1 | 6.0 | 5.0 | 0 | 0.1 | 0 | 0.17 | 60 | 3.0 | 20 |
| 2 | 10.0 | 5.0 | 0 | 0.1 | 0 | 0.17 | 60 | 3.0 | 20 |
| 3 | 30.0 | 5.0 | 0 | 0.1 | 0 | 0.17 | 60 | 3.0 | 20 |
| 4 | 35.0 | 5.0 | 0 | 0.1 | 0 | 0.17 | 60 | 3.0 | 20 |
| 5 | 3.0 | 5.0 | 0 | 0.1 | 0 | 0.17 | 60 | 3.0 | 20 |
| 6 | 1.0 | 5.0 | 0 | 0.1 | 0 | 0.17 | 60 | 3.0 | 20 |
| 7 | 0.5 | 5.0 | 0 | 0.1 | 0 | 0.17 | 60 | 3.0 | 20 |
| 8 | 6.0 | 0.3 | 0 | 0.1 | 0 | 2.8 | 60 | 3.0 | 20 |
| 9 | 6.0 | 0.3 | 0 | 0.005 | 0 | 0.14 | 60 | 3.0 | 20 |
| 10 | 6.0 | 0.5 | 0 | 0.005 | 0 | 0.08 | 60 | 3.0 | 20 |
| 11 | 6.0 | 5.0 | 0 | 0.5 | 0 | 0.84 | 60 | 3.0 | 20 |
| 12 | 6.0 | 25.0 | 0 | 1.0 | 0 | 0.34 | 60 | 3.0 | 20 |
| 13 | 6.0 | 50.0 | 0 | 5.0 | 0 | 0.84 | 60 | 3.0 | 20 |
| 14 | 6.0 | 60.0 | 0 | 5.0 | 0 | 0.71 | 60 | 3.0 | 20 |
| 15 | 6.0 | 50.0 | 0 | 6.0 | 0 | 1.02 | 60 | 3.0 | 20 |
| 16 | 6.0 | 0 | 5.0 | 0.1 | 0 | 0.17 | 60 | 3.0 | 20 |
| 17 | 6.0 | 2.5 | 2.5 | 0.1 | 0 | 0.17 | 60 | 3.0 | 20 |
| 18 | 6.0 | 5.0 | 0 | 0.05 | 0.05 | 0.17 | 60 | 3.0 | 20 |

TABLE 2

| | Composition | | | | | Tin ion/ | | | Spray |
|---|---|---|---|---|---|---|---|---|---|
| | $PO_4^{3-}$ | Organophosphnate compound(mmol/l) | | Tin ion (g/l) | | Organophosphnate compound | Treatment Temperature | | Treatment Time |
| | (g/l) | (A) | (B) | $Sn^{+2}$ | $Sn^{4+}$ | (mole-ratio) | (°C.) | pH | (second) |
| Actual Examples | | | | | | | | | |
| 19 | 6.0 | 5.0 | 0 | 0 | 0.1 | 0.17 | 60 | 3.0 | 20 |
| 20 | 6.0 | 5.0 | 0 | 0.1 | 0 | 0.17 | 60 | 1.5 | 20 |
| 21 | 6.0 | 5.0 | 0 | 0.1 | 0 | 0.17 | 60 | 2.0 | 20 |
| 22 | 6.0 | 5.0 | 0 | 0.1 | 0 | 0.17 | 60 | 5.0 | 20 |
| 23 | 6.0 | 5.0 | 0 | 0.1 | 0 | 0.17 | 60 | 5.5 | 20 |
| 24 | 6.0 | 10.0 | 0 | 0.06 | 0 | 0.05 | 60 | 3.0 | 20 |
| 25 | 6.0 | 4.2 | 0 | 5 | 0 | 10 | 60 | 3.0 | 20 |
| Comparions Examples | | | | | | | | | |
| 1 | 6.0 | 5.0 | 0 | 0 | 0 | 0 | 60 | 3.0 | 20 |
| 2 | 6.0 | 0 | 0 | 0 | 0 | 0 | 60 | 3.0 | 20 |
| 3 | 6.0 | 0 | 0 | 0.1 | 0 | — | 60 | 3.0 | 20 |
| 4 | 6.0 | Pyrophosphate acid 0.2 | | 0.1 | 0 | — | 60 | 3.0 | 20 |
| 5 | 6.0 | Oxalic acid 0.2 | | 0.1 | 0 | — | 60 | 3.0 | 20 |
| 6 | 6.0 | Hypophosphorous acid 0.2 | | 0.1 | 0 | — | 60 | 3.0 | 20 |

TABLE 3

| Actual examples | External Appearance | Corrosion resistance of cans prior to epoxy coating | Corrosion resistance of cans after epoxy coating | Coating adhesiveness | Production of stage |
|---|---|---|---|---|---|
| 1 | Excellent | Good | Excellent | Excellent | Excellent |
| 2 | Excellent | Good | Excellent | Excellent | Excellent |
| 3 | Excellent | Good | Excellent | Excellent | Excellent |
| 4 | Average | Good | Excellent | Excellent | Excellent |
| 5 | Excellent | Good | Excellent | Excellent | Excellent |
| 6 | Excellent | Good | Excellent | Excellent | Excellent |
| 7 | Excellent | Average | Good | Excellent | Excellent |
| 8 | Excellent | Good | Excellent | Excellent | Average |
| 9 | Excellent | Average | Excellent | Excellent | Excellent |
| 10 | Excellent | Good | Excellent | Excellent | Excellent |
| 11 | Excellent | Good | Excellent | Excellent | Excellent |
| 12 | Excellent | Good | Excellent | Excellent | Excellent |
| 13 | Excellent | Good | Excellent | Excellent | Excellent |
| 14 | Average | Good | Excellent | Excellent | Excellent |
| 15 | Excellent | Good | Excellent | Excellent | Excellent |
| 16 | Excellent | Good | Excellent | Excellent | Excellent |
| 17 | Excellent | Good | Excellent | Excellent | Excellent |
| 18 | Excellent | Good | Excellent | Excellent | Excellent |

TABLE 4

| | External Appearance | Corrosion resistance of cans prior to epoxy coating | Corrosion resistance of cans after epoxy coating | Coating adhesiveness | Production of slage |
|---|---|---|---|---|---|
| Actual Examples | | | | | |
| 19 | Excellent | Good | Excellent | Excellent | Excellent |
| 20 | Average | Good | Excellent | Excellent | Excellent |
| 21 | Excellent | Good | Excellent | Excellent | Excellent |
| 22 | Excellent | Good | Excellent | Excellent | Excellent |
| 23 | Excellent | Good | Good | Good | Excellent |
| 24 | Average | Good | Excellent | Excellent | Excellent |
| 25 | Excellent | Good | Excellent | Excellent | Average |
| Comparions Examples | | | | | |
| 1 | Excellent | Average | Good | Good | Excellent |
| 2 | Excellent | Average | Average | Good | Poor |
| 3 | Excellent | Average | Good | Excellent | Poor |
| 4 | Excellent | Average | Good | Good | Poor |
| 5 | Excellent | Good | Excellent | Excellent | Poor |
| 6 | Excellent | Good | Good | Good | Poor |

In the experimentation, comparison example 4 corresponds to a conversion coating solution disclosed in U.S. Pat. No. 4,927,472, comparison example 5 corresponds to a conversion coating solution described in Japan Kokai H2-15178, and comparison example 6 corresponds to a treatment solution with inorganic hypophosphorous acid employed in Japan Kokai 52-53739.

In the actual examples 1 to 25 using a surface treatment aqueous solution in accordance with the present invention, production of salt or precipitation (i.e. sludge) were scarcely seen, and the lifetime of the conversion coating (surface treatment) aqueous solution was substantially long. Consequently, the subsequent transporting and printing processes were smoothly carried out, without obstacles caused by salt or precipitations stuck onto the surface of the cans. Furthermore, as can be seen from the tables, external appearance, corrosion resistance and coating adhesiveness all indicated good results.

The following are preferable modifications of the present invention.

1. The organophosphonate compound contained in the surface treatment aqueous solution is a compound of at least one selected from aminotri (methylenephosphonic acid), 1-hydroxyethylidene-1,1-diphosphonic acid, ethylenediaminetetra (methylenephosphonic acid), dimethylenetriaminepenta (methylenephosphonic acid, and their salts.
2. The organophosphonate compound contained in the surface treatment aqueous solution is a compound of at least one selected from aminotri (methylenephosphonic acid), 1-hydroxyethylidene-1,1-diphosphonic acid, and their salts.
3. A supply source of the phosphate ions contained in the surface treatment aqueous solution is at least one selected from orthophosphoric acid and orthophosphate.
4. A supply source of tin ion contained in the surface treatment aqueous solution is at least one selected from stannous chloride, stannic chloride, sodium stannate, and stannous sulfate.
5. A mole ratio of tin ion to organophosphonate compound in the surface treatment aqueous solution is 0.08 to 8.4.
6. A mole ratio of tin ion to organophosphonate compound in the surface treatment aqueous solution is 0.17 to 2.8.
7. A surface treatment aqueous solution contains phosphoric acid and phosphate with a phosphate ion amount of 1 to 30 g/l, 0.05 to 50.0 mmol/l of organophosphonate compound, and 0.005 to 5.0 g/l of tin ions, with a mole ratio of tin ions to organophosphonate compound being 0.08 to 8.4 and a pH value being 2 to 5.
8. The amount of phosphoric acid and phosphate contained in the surface treatment aqueous solution is such that the phosphate ion amount is 3 to 10 g/l.
9. The amount of organophosphonate compound contained in the surface treatment aqueous solution is 0.5 mmol/l to 5.0 mmol/l.
10. The amount of tin ions contained in the surface treatment aqueous solution is 0.05 to 0.5 g/l.
11. A surface treatment aqueous solution contains 3 to 10 g/l of phosphate ions (in the ion reduction amount), 0.5 to 5 mmol/l of organophosphonate compound, and 0.05 to 0.5 g/l of tin ions, with a mole ratio of tin ions to organophosphonate compound being 0.17 to 2.8 and a pH value being 2 to 5.
12. The pH value of the surface treatment aqueous solution is 2 to 3.5.
13. A surface treatment aqueous solution contains (a) at least one selected from orthophosphoric acid and orthophosphate with a phosphate ion amount of 3 to 10 g/l, (b) 0.5 to 5 mmol/l of at least one organophosphonate compound selected from aminotri (methylenephosphonic acid), 1-hydroxyethylidene-1,1-diphosphonic acid, and their salt, and (c) 0.05 to 0.5 g/l of tin ions, with a mole ratio of tin ions to organophosphonate compound being 0.17 to 1 and a pH value being 2 to 5.
14. The surface treatment aqueous solution is applied to a surface of tinned iron.
15. The surface treatment aqueous solution is applied to a surface of tinned iron which has been degreased and water washed.
16. The surface treatment aqueous solution is applied to a tinned DI can.
17. A thick solution for surface treatment contains at least (a) orthophosphoric acid or orthophosphate with a phosphate ion amount of 10 to 1,500 g/l, (b) 0.5 to 2,500 mmol/l of organophosphonate compound, and (c) 0.05 to 500 g/l of tin ions, with a pH value being 4 or less.
18. A surface treatment aqueous solution is obtained by diluting the thick solution for surface treatment with an appropriate amount of water, and is poured into a treatment bath for use in conversion coating.

As has been described, by using a surface treatment aqueous solution in accordance with the present invention, conversion coating having a superior corrosion resistance can be achieved. The conversion coating also has a superior coating adhesiveness to an upper coating.

During the processing, salt or precipitate is seldom produced in the treatment bath containing the surface treatment aqueous solution of the invention, thereby maintaining a long lifetime of the surface treatment bath. Furthermore, later transporting and printing processes are carried out smoothly without obstacles caused by salt stuck onto the surface of cans.

Organophosphonate compound in which a phosphonate group (—$PO_3H_2$) is bonded to a carbon atom can stably exist over a broad pH range, without being subjected to hydrolysis. Accordingly, its chelating ability for tin ions is also stable, and it is not necessary to continuously add a large amount of chelating agent into the treatment bath during the processing, unlike a treatment solution containing condensed phosphoric acid. organophosphonate compound which is acts to chelate tin ions is considered to be taken into a conversion coating film as a preferable component. In other words, the organophosphonate compound contained in the surface treatment aqueous solution serves as a multifunctional component (functioning as an etchant, a chelating agent, and an ingredient of a conversion coating film), which can remarkably improve both working efficiency and cost efficiency of the treatment solution.

The thus prepared surface treatment aqueous solution is suitable for conversion coating of the tinned surface of iron products, especially, of tinned DI cans.

What is claimed is:

1. A surface treatment aqueous solution for metal, containing at least phosphate ions, at least one organophosphonate compound selected from aminotri (methylenephosphonic acid), 1-hydroxyethylidene-1,1-disphoshonic acid, ethylenediaminetetra (methylenephosphonic acid), diethylenetriaminepenta (methylenephosphonic acid) and their salts, and tin ions, with a pH value being 5 or less.

2. The surface treatment aqueous solution according to claim 1, wherein said organophosphonate compound is a compound of at least one selected from aminotri (methylenephosphonic acid), 1-hydroxyethylidene-1,1-diphosphonic acid, and their salts.

3. The surface treatment aqueous solution according to claim 1, wherein a supply source of said phosphate ions is at least one selected from orthophosphoric acid and orthophosphate.

4. The surface treatment aqueous solution according to claim 1, wherein a supply source of said tin ions is at least one selected from stannous chloride, stannic chloride, sodium stannate, and stannous sulfate.

5. The surface treatment aqueous solution according claim 1, wherein the mole ratio of tin ion to organophosphonate compound is 0.08 to 8.4.

6. The surface treatment aqueous solution according to claim 1, wherein the mole ratio of tin ions to organophosphate compound is 0.17 to 2.8.

7. The surface treatment aqueous solution according to claim 1, wherein the amount of said phosphate ion contained in the aqueous solution is 3 to 10 g/l.

8. The surface treatment aqueous solution according to claim 1, wherein the amount of said phosphate ions contained is 1 to 30 g/l, the amount of said phosphate ions contained is 1 to 30 g/l the amount of said organophosphonate is 0.05 mmol/l to 50 mmol/l, the amount of said tin ions is 0.005 to 5 g/l, the mole ratio of tin ions to organophosphate compound is 0.08 to 8.4, and the pH value of the aqueous solution is 2 to 5.

9. The surface treatment aqueous solution according to claim 1, wherein the amount of said organophosphonate contained in the aqueous solution is 0.5 mmol/l to 5 mmol/l.

10. The surface treatment aqueous solution according to claim 1, wherein the amount of said tin ions contained in the aqueous solution is 0.05 to 0.5 g/l.

11. The surface treatment aqueous solution according to claim 1, wherein the amount of said phosphate ion contained is 3 to 10 g/l, the amount of said organophosphonate compound is 0.5 mmol/l to 5 mmol/l, the amount of said tin ions is 0.05 to 0.5 g/l, the mole ratio of tin ions to organophsophonate compound is 0.17 to 2.8, and the pH value of the aqueous solution is 2 to 5.

12. The surface treatment aqueous solution according to claim 1, wherein the pH value of the aqueous solution is 2 to 3.5.

13. The surface treatment aqueous solution according to claim 8, wherein the pH value of the aqueous solution is 2 to 3.5.

14. The surface treatment aqueous solution according to claim 11, wherein the pH value of the aqueous solution is 2 to 3.5.

15. A surface treatment aqueous solution for metal, containing:

(a) at least one selected from orthophosphoric acid and orthophosphate with a phosphate ion amount of 3 to 10 g/l;

(b) 0.5 mmol/l to 5 mmol/l of at least one organophosphanate compound selected from aminotri (methylenephosphonic acid), 1-hydroxyethylidene-1-1-diphosphonic acid, and salt thereof; and (c) 0.05 to 0.5 g/l of tin ions;

wherein a mole ratio of tin ions to organophosphonate compound is 0.17 to 1, and the pH value of the aqueous solution is 2 to 5.

16. A process of forming a conversion coating film on a surface of tinned iron, comprising steps of:

preparing a surface treatment aqueous solution containing at least phosphate ions, organophosphonate compound, and tin ions, with a pH value being 5 or less; and applying the surface treatment aqueous solution onto a surface of tinned iron which has been degreased and water washed.

17. A process of forming a conversion coating film on a surface of tinned iron, comprising steps of:

preparing a surface treatment aqueous solution containing (a) at least one selected from orthophosphoric acid and orthophosphate with a phosphate ion amount of 3 to 10 g/l, (b) 0.5 mmol/l to 5 mmol/l of at least one organophosphonate compound selected from aminotri (methylenephosphonic acid), 1-hydroxyethylidene-1, 1-diphosphonic acid, and their salt, and (c) 0.05 to 0.5 g/l of tin ions, with a mole ratio of tin ions to organophosphonate compound being 0.17 to 1, and a pH value being 2 to 5;

applying the surface treatment aqueous solution onto a surface of tinned iron which has been degreased and water washed.

* * * * *